US009986338B2

(12) United States Patent
Mansfield et al.

(10) Patent No.: US 9,986,338 B2
(45) Date of Patent: May 29, 2018

(54) REFLECTED SOUND RENDERING USING DOWNWARD FIRING DRIVERS

(71) Applicant: DOLBY LABORATORIES LICENSING CORPORATION, San Francisco, CA (US)

(72) Inventors: Warren Mansfield, Petaluma, CA (US); Eugene Edward Radzik, San Leandro, CA (US); Alan J. Seefeldt, Alameda, CA (US); Jared Smith, San Francisco, CA (US); C. Phillip Brown, Castro Valley, CA (US); Michael Smithers, Kareela (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days. days.

(21) Appl. No.: 15/107,031

(22) PCT Filed: Jan. 6, 2015

(86) PCT No.: PCT/US2015/010365
§ 371 (c)(1),
(2) Date: Jun. 21, 2016

(87) PCT Pub. No.: WO2015/105809
PCT Pub. Date: Jul. 16, 2015

(65) Prior Publication Data

US 2017/0026750 A1 Jan. 26, 2017

Related U.S. Application Data

(60) Provisional application No. 61/925,806, filed on Jan. 10, 2014, provisional application No. 62/024,819, filed on Jul. 15, 2014.

(51) Int. Cl.
*H04R 5/02* (2006.01)
*H04S 7/00* (2006.01)
(Continued)

(52) U.S. Cl.
CPC ..... *H04R 5/02* (2013.01); *H04R 3/14* (2013.01); *H04S 7/301* (2013.01); *H04S 7/307* (2013.01);
(Continued)

(58) Field of Classification Search
USPC ... 381/17, 27, 56, 57, 86, 92, 300, 302, 306
See application file for complete search history.

(56) References Cited

U.S. PATENT DOCUMENTS 5,088,574 A 2/1992 Kertesz
5,802,181 A 9/1998 Ozaki
(Continued)

FOREIGN PATENT DOCUMENTS

DE 202006006371 7/2006
EP 1713306 10/2006
(Continued)

OTHER PUBLICATIONS

Stanojevic, Tomislav "3-D Sound in Future HDTV Projection Systems," 132nd SMPTE Technical Conference, Jacob K. Javits Convention Center, New York City, New York, Oct. 13-17, 1990, 20 pages.

(Continued)

*Primary Examiner* — Yosef K Laekemariam

(57) ABSTRACT

Embodiments are directed to speakers and circuits that reflect sound off a wall surface (114) to a listening location at a distance from a speaker. The reflected sound (103) provides direct audio cues to reproduce audio objects that have direct audio components without the need for direct firing speakers. The speaker comprises sideward firing drivers (108) to reflect sound off of the wall surface (114) and represents a virtual direct speaker (116). A virtual direct filter is applied to the sideward-firing driver signal to improve the perception of direct audio transmitted by the sideward firing
(Continued)

speaker (108) to provide optimum reproduction of the reflected sound. The virtual direct filter may be incorporated as part of a crossover circuit that separates the full band and sends high frequency sound to the sideward-firing driver (108).

19 Claims, 12 Drawing Sheets

(51) Int. Cl.
*H04R 3/14* (2006.01)
*H04R 1/34* (2006.01)
*H04R 5/04* (2006.01)

(52) U.S. Cl.
CPC ..... *H04R 1/345* (2013.01); *H04R 5/04* (2013.01); *H04R 2201/021* (2013.01); *H04R 2201/025* (2013.01); *H04R 2205/024* (2013.01); *H04S 7/305* (2013.01); *H04S 2400/11* (2013.01); *H04S 2420/07* (2013.01)

(56) References Cited

U.S. PATENT DOCUMENTS

| | | | | |
|---|---|---|---|---|
| 5,809,150 | A | 9/1998 | Eberbach | |
| 6,259,795 | B1 | 7/2001 | McGrath | |
| 6,850,496 | B1 * | 2/2005 | Knappe | H04M 3/56 370/260 |
| 7,142,680 | B2 | 11/2006 | Gelow | |
| 7,548,630 | B2 | 6/2009 | Schlenker | |
| 8,254,603 | B2 | 8/2012 | Suzuki | |
| 8,265,284 | B2 | 9/2012 | Villemoes | |
| 2005/0025318 | A1 | 2/2005 | Sadaie | |
| 2006/0251271 | A1 | 11/2006 | Grimani | |
| 2008/0144864 | A1 | 6/2008 | Huon | |

FOREIGN PATENT DOCUMENTS

| | | | | |
|---|---|---|---|---|
| EP | 1793646 | | 6/2007 | |
| JP | 2004-146953 | | 5/2004 | |
| JP | 2004-328678 | | 11/2004 | |
| JP | 2005-012765 | | 1/2005 | |
| JP | 2012-049663 | | 3/2012 | |
| JP | 2012049663 | * | 8/2012 | H04R 1/345 |
| RS | 1332 U | | 8/2013 | |

OTHER PUBLICATIONS

Stanojevic, Tomislav "Surround Sound for a New Generation of Theaters," Sound and Video Contractor, Dec. 20, 1995, 7 pages.
Stanojevic, Tomislav "Virtual Sound Sources in the Total Surround Sound System," SMPTE Conf. Proc.,1995, pp. 405-421.
Stanojevic, Tomislav et al. "Designing of TSS Halls," 13th International Congress on Acoustics, Yugoslavia, 1989, pp. 326-331.
Stanojevic, Tomislav et al. "Some Technical Possibilities of Using the Total Surround Sound Concept in the Motion Picture Technology," 133rd SMPTE Technical Conference and Equipment Exhibit, Los Angeles Convention Center, Los Angeles, California, Oct. 26-29, 1991, 3 pages.
Stanojevic, Tomislav et al. "The Total Surround Sound (TSS) Processor," SMPTE Journal, Nov. 1994, pp. 734-740.
Stanojevic, Tomislav et al. "The Total Surround Sound System (TSS System)", 86th AES Convention, Hamburg, Germany, Mar. 7-10, 1989, 21 pages.
Stanojevic, Tomislav et al. "TSS Processor" 135th SMPTE Technical Conference, Los Angeles Convention Center, Los Angeles, California, Society of Motion Picture and Television Engineers, Oct. 29-Nov. 2, 1993, 22 pages.
Stanojevic, Tomislav et al. "TSS System and Live Performance Sound" 88th AES Convention, Montreux, Switzerland, Mar. 13-16, 1990, 27 pages.
Sasaki, Y. et al "A Predefined Command Recognition System Using a Ceiling Microphone Array in Noisy Housing Environments" IEEE International Conference on Intelligent Robots and Systems, Sep. 22-26, 2008.
Kim, Sungyoung "Virtual Ceiling Speaker: Elevating Auditory Imagery in a 5-Channel Reproduction" Proc. of Meetings on Acoustics, v. 19, 2013.
Ikeda, A. et al "2D Sound Source Localization in Azimuth & Elevation from Microphone Array by Using a Directional Pattern of Element" IEEE Sensors, Oct. 28-31, 2007, pp. 1213-1216.
Shujau, M. et al "Linear Predictive Perceptual Filtering for Acoustic Vector Sensors: Exploiting Directional Recordings for High Quality Speech Enhancement" IEEE International Conference on Acoustics, Speech and Signal Prcoessing, May 22-27, pp. 5068-5071.

* cited by examiner

REFLECTED SOUND RENDERING USING DOWNWARD FIRING DRIVERS

CROSS REFERENCE TO RELATED APPLICATIONS

This application claims priority to U.S. Provisional Patent Application No. 61/925,806, filed on 10 Jan. 2014 and U.S. Provisional Patent Application No. 62/024,819, filed on 15 Jul. 2014, each of which is hereby incorporated by reference in its entirety.

FIELD OF THE INVENTION

One or more implementations relate generally to audio signal processing, and more specifically to speakers and circuits for rendering adaptive audio content using reflected signals generated by downward firing speakers.

BACKGROUND

The advent of digital cinema has created new standards for cinema sound, such as the incorporation of multiple channels of audio to allow for greater creativity for content creators and a more enveloping and realistic auditory experience for audiences. Model-based audio descriptions have been developed to extend beyond traditional speaker feeds and channel-based audio as a means for distributing spatial audio content and rendering in different playback configurations. The playback of sound in true three-dimensional (3D) or virtual 3D environments has become an area of increased research and development. The spatial presentation of sound utilizes audio objects, which are audio signals with associated parametric source descriptions of apparent source position (e.g., 3D coordinates), apparent source width, and other parameters. Object-based audio may be used for many multimedia applications, such as digital movies, video games, simulators, and is of particular importance in a home environment where the number of speakers and their placement is generally limited or constrained by the confines of a relatively small listening environment.

Various technologies have been developed to more accurately capture and reproduce the creator's artistic intent for a sound track in both full cinema environments and smaller scale home environments. A next generation spatial audio (also referred to as "adaptive audio") format has been developed that comprises a mix of audio objects and traditional channel-based speaker feeds along with positional metadata for the audio objects. In a spatial audio decoder, the channels are sent directly to their associated speakers or down-mixed to an existing speaker set, and audio objects are rendered by the decoder in a flexible manner. The parametric source description associated with each object, such as a positional trajectory in 3D space, is taken as an input along with the number and position of speakers connected to the decoder. The renderer utilizes certain algorithms to distribute the audio associated with each object across the attached set of speakers. The authored spatial intent of each object is thus optimally presented over the specific speaker configuration that is present in the listening environment.

Current spatial audio systems have generally been developed for cinema use, and thus involve deployment in large rooms and the use of relatively expensive equipment, including arrays of multiple speakers distributed around a theater. An increasing amount of advanced audio content, however, is being made available for playback in the home environment through streaming technology and advanced media technology, such as Blu-ray disks, and so on. In addition, emerging technologies such as 3D television and advanced computer games and simulators are encouraging the use of relatively sophisticated equipment, such as large-screen monitors, surround-sound receivers and speaker arrays in home and other listening environments. In spite of the availability of such content, equipment cost, installation complexity, and room size remain realistic constraints that prevent the full exploitation of spatial audio in most home environments.

Object-based (e.g., adaptive) audio in the home environment consists of audio signals being presented to the listener originating from in front of and around the listening position in the horizontal plane (main speakers) and overhead plane (height speakers). A common object based audio playback system will consist of front, side and back surround, height loudspeakers and subwoofer. A full home enabled loudspeaker system layout will typically consist of: front loudspeakers (e.g., Left, Center, Right, and optionally Left Center Right Center, Left Screen, Right Screen, Left Width, and Right Width), Surround loudspeakers (e.g., Left Surround, Right Surround, and optionally Left Surround 1, Right Surround 1, Left Surround 2, Right Surround 2), surround back loudspeakers (e.g., Left Rear Surround, Right Rear Surround, Center Surround, and optionally Left Rear Surround 1, Right Rear Surround 1, Left Rear Surround 2, Right Rear Surround 2, Left Center Surround, Right Center Surround), height loudspeakers (e.g., Left Front Height, Right Front Height, Left Top Front, Right Top Front, Left Top Middle, Right Top Middle, Left Top Rear, Right Top Rear, Left Rear Height, Right Rear Height), and subwoofer speakers. Loudspeakers come in various types, such as: in-room (traditional box speakers on a stand or in a cabinet); in-wall (traditionally mounted in the wall in the horizontal plane around the listener); on-wall (traditionally mounted on the wall in the horizontal plane around the listener) d) in-ceiling (traditionally in the ceiling above the listener for the surrounds and far forward for the fronts); and on-ceiling (traditionally on the ceiling above the listener for the surrounds and far forward for the fronts). Depending upon personal taste and the physical and aesthetic restrictions that are placed upon them by the homeowner, the user's loudspeaker system can be exclusive to each of the above loudspeaker types or any combination of the above loudspeaker types.

Ceiling (in-ceiling or on-ceiling) or upper wall mounted speakers (collectively referred to as "downward-firing speakers") are becoming increasingly used in home playback systems. Such speakers represent a good solution for homeowners that are unable or unwilling to use in-wall, on-wall or in-room loudspeakers. This could be because homeowners have windows, doors, walkways or artwork in the way for in-wall loudspeakers or simply no space for in-room box type loudspeakers. In these commonly occurring situations ceiling loudspeakers often represent the only alternative, leading to their popularity.

To recreate the intended adaptive audio experience in the home, audio is necessary to arrive to the listening position from common main outputs (left, center, right, left surround, right surround, left back surround and right back surround) as well as from height outputs. Currently, ceiling type loudspeakers are only designed to play back audio associated with height outputs from single sources. This ceiling loudspeaker needs to provide not only the audio from the height outputs but also audio for the main outputs where necessary in the home installation, i.e. front, side surround and back surround. In many cases, and especially in the home environment, direct speakers may not be available. In this case, the direct information is lost if such sound objects are played only through ceiling mounted speakers.

What is needed, therefore, is a system that allows full spatial information of an adaptive audio system to be reproduced in a listening environment that may include only a portion of the full speaker array intended for playback, such as ceiling speakers only with no direct speakers.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF EMBODIMENTS

Embodiments are directed to speakers and circuits that reflect sound from a downward-firing speaker off a wall surface to a listening location at a distance from the speaker. The reflected sound provides audio cues to reproduce audio objects that have direct sound components. The speaker comprises a downward firing speaker to provide height components and one or more angled drivers to reflect sound off of the wall surface and represents a virtual direct speaker. The direct audio component is provided by the reflected sound for cases where no direct speaker is available or used. A virtual direct filter based on a directional hearing model is applied to the sideward-firing driver signal to improve the perception of directness for audio signals transmitted by the virtual direct speaker to provide optimum reproduction of the downward reflected sound, by removing the pure downward audio cues that may be present in the reflected signal so that the reflected provides only the direct audio cues. Additionally, the virtual direct filter may be incorporated as part of a crossover circuit that separates the full band and sends specific frequency bands (e.g., mid to low) to the sideward-firing driver. Room correction processes are also used to provide calibration and maintain virtual direct filtering in systems that perform automatic room equalization and other anomaly negating processes.

Such speakers and circuits are configured to be used in conjunction with an adaptive audio system for rendering sound using reflected sound elements comprising an array of audio drivers for distribution around a listening environment from the ceiling or high upper surface; a renderer for processing audio streams and one or more metadata sets that are associated with each audio stream and that specify a playback location in the listening environment of a respective audio stream, wherein the audio streams comprise one or more reflected audio streams and one or more direct audio streams; and a playback system for rendering the audio streams to the array of audio drivers in accordance with the one or more metadata sets, and wherein the one or more reflected audio streams are transmitted to the reflected (sideward-firing) audio drivers.

Embodiments are further directed to speakers or speaker systems that incorporate a desired frequency transfer function directly into the transducer design of the speakers configured to reflect sound off of lower wall surfaces to provide virtual direct audio, wherein the desired frequency transfer function filters downward sound components from direct sound components in an adaptive audio signal produced by a renderer.

Embodiments are yet further directed to methods of making and using or deploying the speakers, circuits, and transducer designs that optimize the rendering and playback of reflected sound content using a frequency transfer function that filters downward sound components from direct sound components in an audio playback system.

In general, embodiments are designed specifically for play back of object based audio content in the home, to provide simultaneous height and lower elevation audio content all from ceiling mounted loudspeaker devices. The speaker devices may have dedicated inputs for each output to simultaneously and independently play back audio for both height and main outputs from an AVR. A direct transfer function perceptual filter may be used and can either be built in to the main output loudspeaker sections as an electrical filter or incorporated as a modified target transfer function of the speaker transducer itself. The in-ceiling or on-ceiling drivers may include a mechanism to enable accurate aiming of the main output sections to point at the desired reflective structure (e.g., wall). Alternatively, the virtual direct audio component can be provided by just using the perceptual filter above. The directivity of the sideward firing main output sections may have an off-axis acoustical energy that can be attenuated by some means in order to reduce the interaction of the off-axis energy and the reflected on-axis energy when arriving at the listening position.

INCORPORATION BY REFERENCE

Each publication, patent, and/or patent application mentioned in this specification is herein incorporated by reference in its entirety to the same extent as if each individual publication and/or patent application was specifically and individually indicated to be incorporated by reference.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Figure 1:
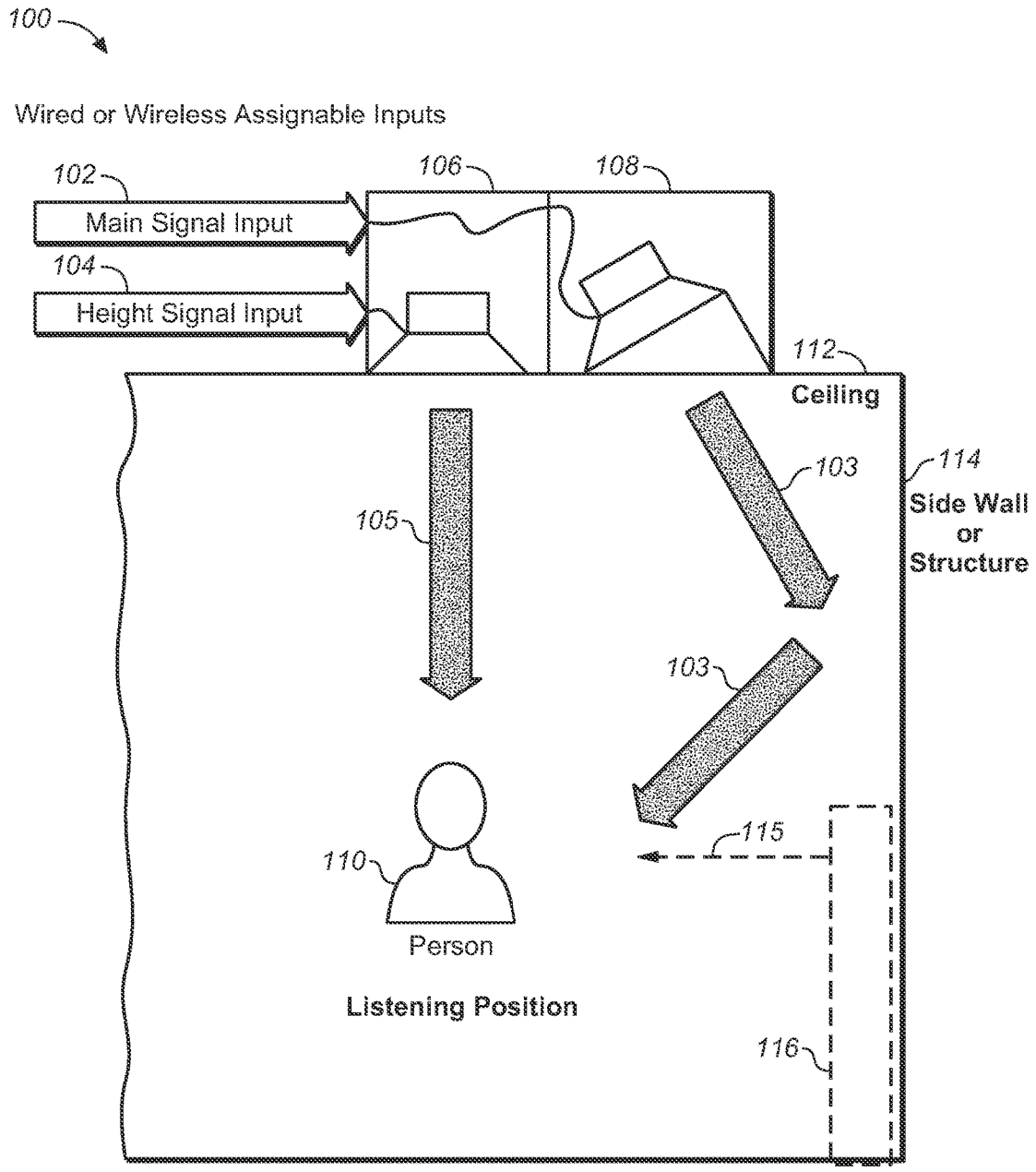
FIG. 1 illustrates the use of a downward-firing driver using reflected sound to simulate one or more direct speakers.

Systems and methods are described for an adaptive audio system that renders reflected sound for adaptive audio systems through downward-firing speakers that incorporate virtual direct filter circuits for rendering object based audio content using reflected sound to reproduce direct sound objects and provide direct audio cues in systems that lack direct speakers. Aspects of the one or more embodiments described herein may be implemented in an audio or audio-visual (AV) system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

For purposes of the present description, the following terms have the associated meanings: the term "channel" means an audio signal plus metadata in which the position is coded as a channel identifier, e.g., left-front or right-top surround; "channel-based audio" is audio formatted for playback through a pre-defined set of speaker zones with associated nominal locations, e.g., 5.1, 7.1, and so on; the term "object" or "object-based audio" means one or more audio channels with a parametric source description, such as apparent source position (e.g., 3D coordinates), apparent source width, etc.; and "adaptive audio" means channel-based and/or object-based audio signals plus metadata that renders the audio signals based on the playback environment using an audio stream plus metadata in which the position is coded as a 3D position in space; and "listening environment" means any open, partially enclosed, or fully enclosed area, such as a room that can be used for playback of audio content alone or with video or other content, and can be embodied in a home, cinema, theater, auditorium, studio, game console, and the like. Such an area may have one or more surfaces disposed therein, such as walls or baffles that can directly or diffusely reflect sound waves.

Embodiments are directed to a reflected sound rendering system that is configured to work with a sound format and processing system that may be referred to as a "spatial audio system" or "adaptive audio system" that is based on an audio format and rendering technology to allow enhanced audience immersion, greater artistic control, and system flexibility and scalability. An overall adaptive audio system generally comprises an audio encoding, distribution, and decoding system configured to generate one or more bitstreams containing both conventional channel-based audio elements and audio object coding elements. Such a combined approach provides greater coding efficiency and rendering flexibility compared to either channel-based or object-based approaches taken separately.

In general, audio objects can be considered as groups of sound elements that may be perceived to emanate from a particular physical location or locations in the listening environment. Such objects can be static (stationary) or dynamic (moving). Audio objects are controlled by metadata that defines the position of the sound at a given point in time, along with other functions. When objects are played back, they are rendered according to the positional metadata using the speakers that are present, rather than necessarily being output to a predefined physical channel.

An example implementation of an adaptive audio system and associated audio format is the Dolby Atmos platform. Such a system incorporates a height (up/down) dimension that may be implemented as a 9.1 surround system, or similar surround sound configuration (e.g., 11.1, 13.1, 19.4, etc.). A 9.1 surround system may comprise composed five speakers in the floor plane and four speakers in the height plane. In general, these speakers may be used to produce sound that is designed to emanate from any position more or less accurately within the listening environment. In a typical commercial or professional implementation speakers in the height plane are usually provided as ceiling mounted speakers or speakers mounted high on a wall above the audience, such as often seen in a cinema. These speakers provide height cues for signals that are intended to be heard above the listener by directly transmitting sound waves down to the audience from overhead locations.

Virtual Direct Speaker System

In many cases, such as typical home environments, ceiling mounted overhead speakers are preferred over direct standing or tower speakers that take up room on the floor. In this case, the direct sound and audio cues must be provided by the downward firing, ceiling mounted speakers. In an embodiment, the direct audio dimension is provided by downward-firing speakers that simulate direct speakers by reflecting sound off of the wall or walls of a listening room. In an adaptive audio system, certain virtualization techniques are implemented by the renderer to reproduce direct audio content through these downward-firing speakers, and the speakers use the specific information regarding which audio objects should be rendered above the standard horizontal plane to direct the audio signals accordingly.

For purposes of description, the term "driver" means a single electroacoustic transducer that produces sound in response to an electrical audio input signal. A driver may be implemented in any appropriate type, geometry and size, and may include horns, cones, ribbon transducers, and the like. The term "speaker" means one or more drivers in a unitary enclosure, and the terms "cabinet" or "housing" mean the unitary enclosure that encloses one or more drivers.

In a typical listening environment, it is necessary for audio to arrive at the listening position from common main outputs (left, center, right, left surround, right surround, left back surround and right back surround) as well as from height outputs. Currently, ceiling type loudspeakers are only designed to play back audio associated with height outputs from single sources. In a direct virtualization system, the ceiling speaker(s) need to provide not only the audio from the height outputs but also audio for the main outputs where necessary in the home installation, i.e. front, side surround and back surround. FIG. 1 illustrates the use of a downward-firing driver using reflected sound to simulate one or more direct speakers. Diagram 100 illustrates an example in which a listening position 110 is located at a particular place within a listening environment comprising a ceiling or upper surface 112 and walls or side surfaces 114. As shown in FIG. 1, the input audio signal comprises a main signal component 102 and a height signal component 104. The input audio signal may be provided to the drivers through wired connections, wireless assignable inputs, or other appropriate transmission means. The height signal 104 represents sound content (audio objects or channels) that contain height cues that are rendered and meant to be perceived by the user as emanating from above the listening position 110. The main signal component 102, also referred to as the direct signal, represents sound content (audio objects or channels) that contain the direct audio cues that are rendered and meant to be perceived by the user as emanating in front, behind or to the side of the user. For the embodiment of FIG. 1, one or more in-ceiling or on-ceiling speakers are provided, but the system does not include floor, wall or side speakers for transmitting audio the direct audio content. The ceiling speaker cabinet or speaker array includes a downward firing driver 106 that receives the height signal input 104 and transmits the downward audio signal 105 to the listening position 110. It also includes a tilted or sideward-firing driver 108 that receives the main signal input and transmits the direct audio signal 103 toward the wall 114 where it is reflected toward the listening position 110. This reflection makes it sound like the main signal is emanating from a direct speaker 116 along a direct sound axis 115. In this manner, the direct audio content has been virtualized by the reflection generated by sideward-firing driver 108.

It is assumed that the wall or side structure 114 is made of an appropriate material and composition to adequately reflect sound directly into the listening environment. The relevant characteristics of the downward and sideward-firing drivers 106, 108 (e.g., size, power, location, etc.) may be selected based on the wall composition, room size, and other relevant characteristics of the listening environment.

The embodiment of FIG. 1 illustrates a case in which the downward and sideward firing drivers are enclosed within a unitary speaker cabinet or a cabinet that may be divided, but that receives the main and height audio signal inputs 102, 104 together. It should be noted, however, that other different speaker packaging arrangements may be used. Furthermore, each driver 106 and 108 may be embodied by single driver or transducer elements, or multiple drivers that form a cluster or array for amplifying or focusing the transmitted sound.

Figure 2:
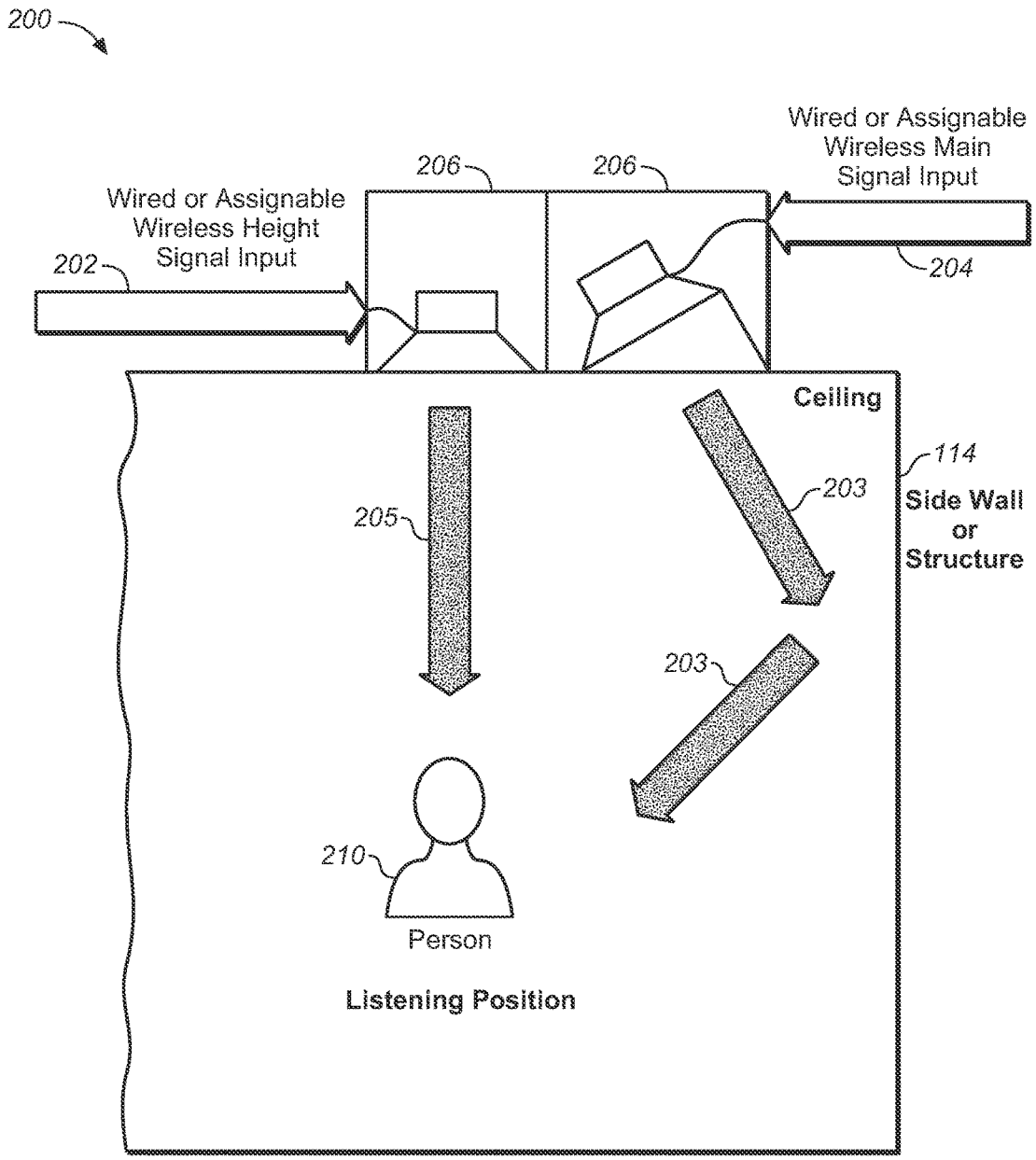
FIG. 2 illustrates an embodiment in which the downward firing driver(s) and sideward firing driver(s) are provided in separate cabinets.

FIG. 2 illustrates an embodiment in which the downward firing driver(s) and sideward firing driver(s) are provided in separate cabinets. The embodiment of FIG. 2 may represent a case in which the virtual direct speaker is provided as an add on module to an existing in-ceiling installation. As shown in FIG. 2, downward firing driver 206 receives height signal input 202 and transmits the downward audio signal 205 to listening position 210. A separate sideward-firing driver 206 provided in its own cabinet separately receives main signal input 204 and transmits the main audio signal 203 to the wall where it reflects over to the listening position 210 so that the audio sounds like it emanates from the side (i.e., as shown by vector 115 in FIG. 1).

Although only one sideward-firing driver (and downward firing driver) is shown in each of FIG. 1 and FIG. 2, multiple drivers may be incorporated into a reproduction system in some embodiments. For the embodiment of FIGS. 1 and 2, it should be noted that the drivers may be of any appropriate, shape, size and type depending on the frequency response characteristics required, as well as any other relevant constraints, such as size, power rating, component cost, and so on.

As shown in FIGS. 1 and 2, the sideward-firing drivers are positioned such that they project sound at an angle to the wall where it can then bounce back across to a listener. The angle of tilt may be set depending on listening environment characteristics and system requirements. For example, the sideward driver 108 may be tilted between 30 and 45 degrees relative to the ceiling plane and may be positioned next to the downfiring driver 106 in the speaker enclosure so as to minimize interference between the sound waves produced from the drivers. The sideward-firing driver 108 may be installed at a fixed angle, or it may be installed such that the tilt angle may be adjusted manually. Alternatively, a servo mechanism may be used to allow automatic or electrical control of the tilt angle and projection direction.

The embodiments of FIGS. 1 and 2 illustrate that each single ceiling loudspeaker location can do the job of representing two loudspeaker locations, the height speaker and a lower elevation main speaker through the direct audio virtualization method created by sound reflection off of a side wall or walls. The virtualization effect may be provided by two different mechanisms. In a first embodiment, a mechanical solution includes redirecting and reflecting sound by physically aiming the main output speaker section, and which also includes a perceptual filter to filter downward sound components from the virtualized direct (reflected) components. In a second embodiment, an electrical solution includes a perceptual filter only that negates the need to aim the main output speaker.

In a first embodiment, in which mechanical means provide differentiation of the height and main audio outputs, as shown in FIGS. 1 and 2, the drivers will have multiple inputs, one for each corresponding main or height audio output of the source product (e.g., a spatial audio enabled AVR) for playback. The height audio input 104 will play back the acoustic height information, and as shown in FIG. 1, this is through a downward firing speaker driver from above and towards the listener. The height output audio speaker driver assembly will be its own dedicated driver transducer/crossover/enclosure system. The main audio input 102 plays back acoustic information from the main outputs (such as a front, side surround or back surround outputs) that are normally positioned at a lower elevation on the horizontal plane approximately at the listener's ear height in a typical non-ceiling speaker system (e.g., an in-room speaker system). This input will be a dedicated driver transducer/crossover/enclosure system that can be mechanically angled and tilted to point away from the listening position to be reflected back to the listening position in a mirror like fashion, as shown in FIGS. 1 and 2.

This mechanical system is intended to be easily accessed and adjusted by the consumer. Actual system design may be left to the discretion of the designer but examples of such mechanical systems include, but are not limited to, an eye-socket ball type housing or a horizontal pan with vertical tilt mechanism on a ratchet, pressure fit, or screw alignment system to implement the directional adjustment of the sideward (main) driver 108. This driver has the ability to be variably directed towards the reflective surface structure (wall) in order for it to reflect acoustic information back to the listening position in a variety of locations around the listener as well as different distances from the listener.

In order to adjust for wall position and distance from the listening position, the adjustments in some designs may be part of an articulated arm or a rotating and tilting mechanism in an in-ceiling speaker design for example. The tilt mechanism is designed to be adjusted both horizontally and vertically to provide sufficient range of adjustment for reflection of the direct sound signal along the wall.

In an embodiment, the virtual direct speaker system includes a virtual filter implemented in the main audio output section that meets a certain frequency response target function. This filter function represents an acoustic characteristic that perceptually repositions the audio so as the sound originating from above is perceived to originate from a lower elevation to better achieve the goals of the adaptive audio playback experience. This can be implemented by either an electrical target transfer function filter added to the loudspeaker system or a target transfer function inherent in the design of the loudspeaker transducer driver itself thereby reducing or negating the need for the extra physical parts in the system itself. In general, the height output section directly passes through the height signal input and has no such filter characteristic.

In an embodiment, specific elements of directivity may be added to or built-in to the virtual direct speaker system and main output section. For example, the acoustic characteristics of the main audio output section may be configured such that the acoustical energy on-axis is predominantly greater than that of the off axis response facing the listening position 110.

Figure 3:
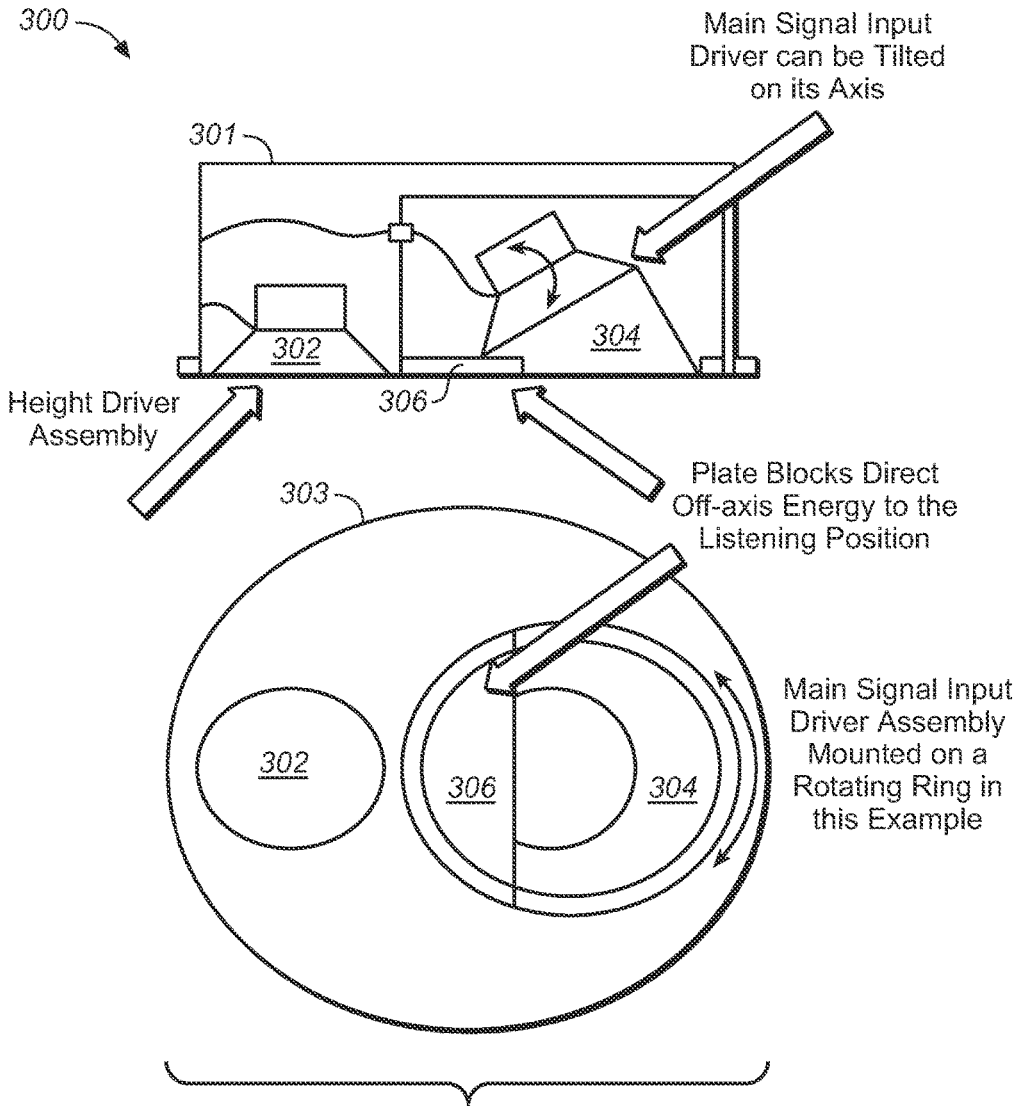
FIG. 3 illustrates a direct virtual driver system having a directivity baffle, under an embodiment.

Unwanted off axis acoustic energy may be reduced by various methods that are up to the discretion of the designer. In an embodiment, the speaker may be recessed into the loudspeaker cabinet and the baffle surface extended to obstruct that part of the speaker that is in direct line with the listener or, a blocking plate made of a rigid material could be added as part of the loudspeaker assembly process. FIG. 3 illustrates a direct virtual driver system having a directivity baffle, under an embodiment. Diagram 300 of FIG. 3 shows a side view 301 of the system, as well as a bottom view 303 of the system, as viewed looking up to the ceiling where the speaker is installed. The height driver assembly 302 comprises a driver (typically one, but more are also possible) aimed directly down into the room at an angle of 90 degrees (or thereabouts) relative to the ceiling plane. The main signal input is transmitted by sideward firing driver 304 that is tilted at some angle relative to the ceiling plane to reflect sound off of the wall. A plate 306 that partially covers the transmission area of the main driver 304 provides blockage of any undesired off-axis acoustic energy from the main driver. As shown in the bottom view 303, the main driver may be mounted on a rotating ring to move the position of the baffle relative to the driver. The main driver may be asymmetrical (e.g., oblong) in shape to provide differential blockage by the baffle when the baffle is fixed and the driver is rotated, as shown in FIG. 3. Alternatively, the baffle 306 may be movable and/or extendable to provide variable amounts of blockage of the off-axis acoustical energy. Foam or some other absorbent material may also be used around the obstruction or blocking plate 306 to reduce any unwanted reflections.

FIG. 3 illustrates a speaker system in which the output drivers can be adjusted in two planes. The main speaker output section is rotatable in order to align it to the desired reflective side surface, and it can be tilted on its axis to point directly at the reflective surface. In an embodiment, only the sideward firing driver transmitting the main audio component has directivity characteristics built-in or provided, and the height driver and output section has no such directivity characteristic.

With regard to the reflecting structure, the ceiling main output section is to be aimed at a reflecting structure in order to replicate the audible cues of a speaker located near listener height, for example floorstanding tower speakers. This structure has the task of reflecting the acoustical energy back towards the listening position. In general, it is not necessary that the reflective structure be purpose built, and can be a normal interior wall structure that may also include a door, window(s) and may be covered by artwork, bookshelves, etc. as long as it has reasonable reflective qualities.

Figure 4:
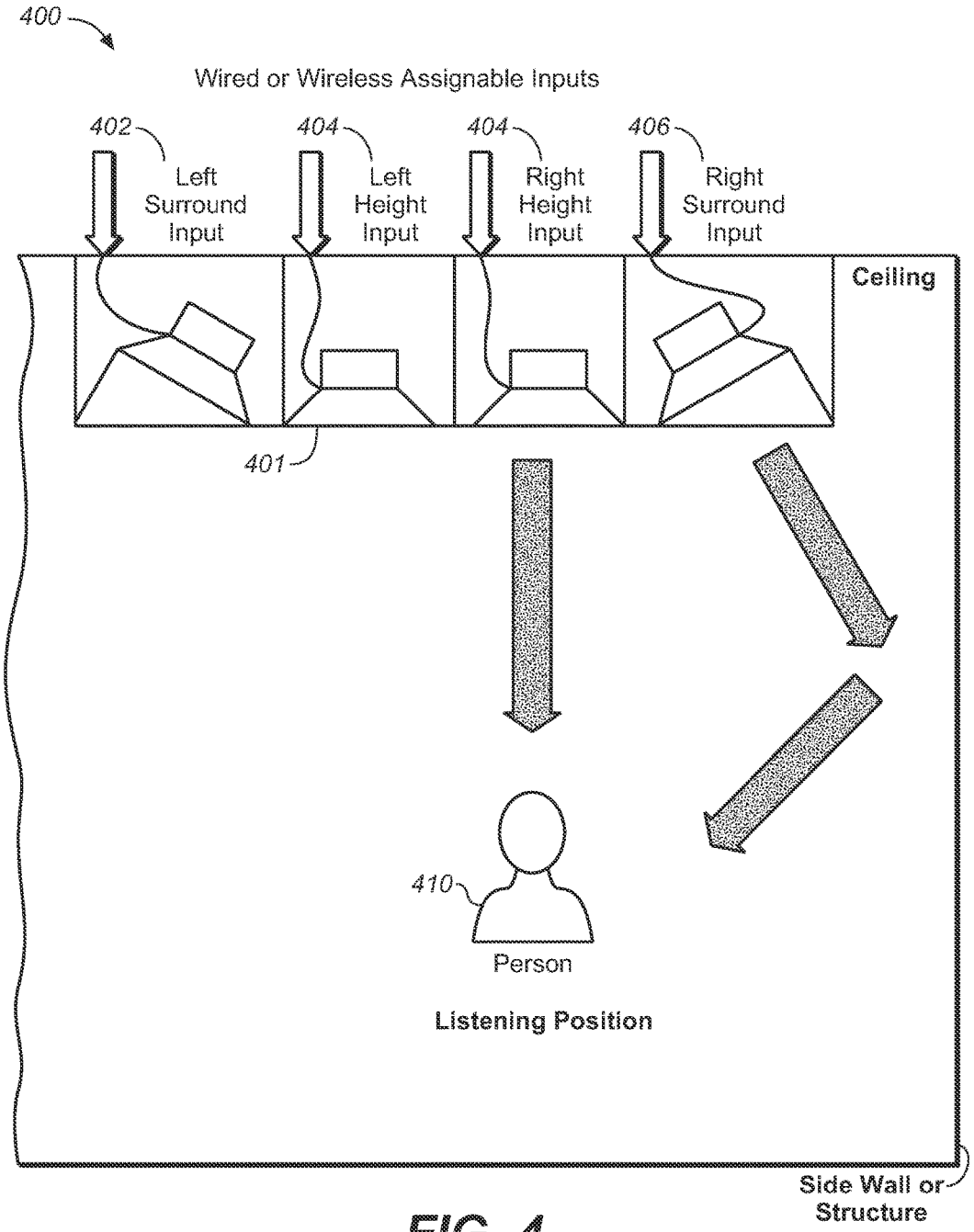
FIG. 4 illustrates an on-ceiling surround sound driver configuration under an embodiment.

As stated above, various different driver packaging arrangements may be used to implement the height and virtual direct driver system. FIGS. 1 and 2 illustrate embodiments in which the drivers are provided in unitary or separate in-ceiling enclosures. Alternatively, the drivers may be provided in an on-ceiling system. FIG. 4 illustrates an on-ceiling downward-firing driver system using reflected sounds to simulate one or more direct speakers, under an embodiment. As shown in diagram 400, a unitary or divided speaker enclosure 401 is installed on a ceiling surface and includes several drivers. The example shown illustrates a surround or partial surround system where each driver may provide a surround sound component, e.g., left/right height and left/right surround, as shown. The height input drivers 404 are transmit sound directly down into the room, while the surround drivers 402 and 406 are mounted sidewards at a defined (and possibly variable) angle to transmit sound off of the walls for reflection to the listening position 410.

Figure 5:
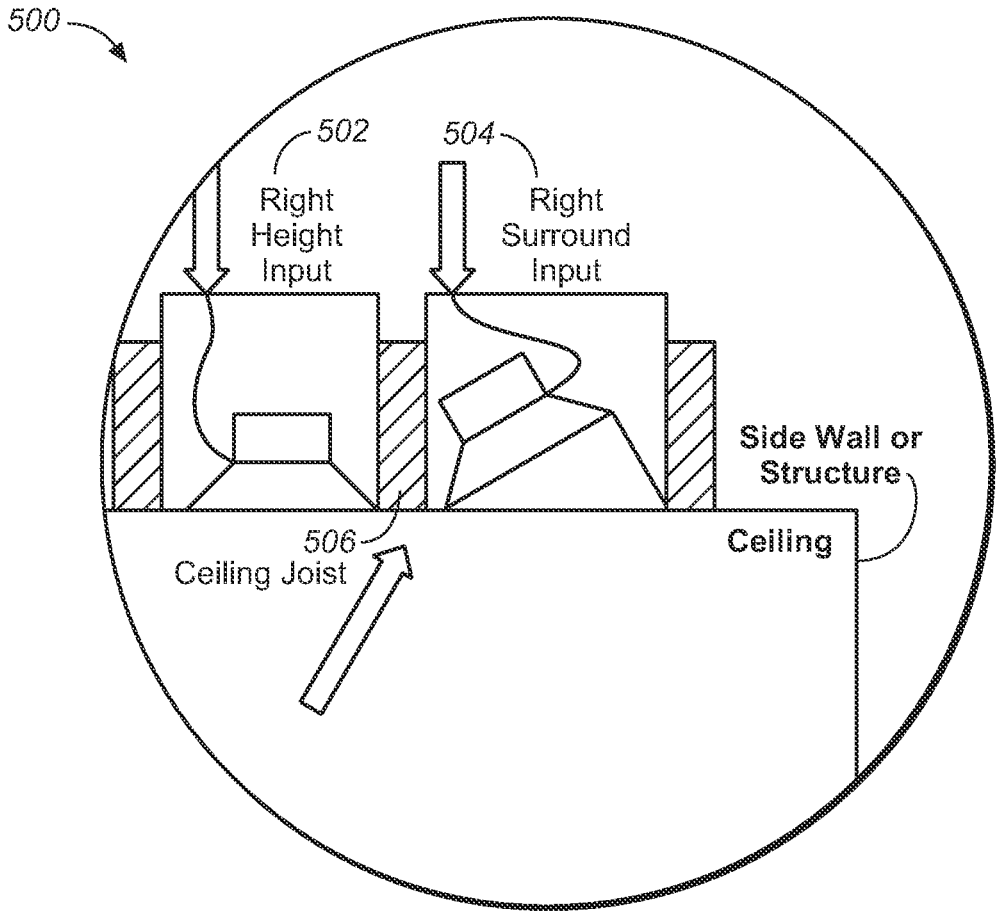
FIG. 5 illustrates an in-ceiling surround sound driver configuration under an embodiment.

The surround sound driver configuration may be implemented in various different ways, such as through the soundbar implementation of FIG. 4, or through corner or high wall mounted speakers. In an embodiment, downward and sideward firing drivers may be at least partially provided using in-ceiling enclosures. Such enclosures may need to be designed to accommodate the structural constraints of home roof designs, such as braces, joists and so on. For example, in an in-ceiling installation, the surround sound speaker bar could be either a single piece with the a depth no more than that of standard ceiling joist width in order to fit lengthwise along the joist. Alternatively, the speaker arrangement may separate at each driver section enclosure to fit in-between each ceiling joist if to be mounted perpendicular, across the joists, and FIG. 5 illustrates an in-ceiling surround sound driver configuration under this embodiment. Diagram 500 is a partial drawing of a surround sound configuration illustrating the separation of height drivers 502 and surround drivers 504 separated by ceiling joists 506. Other similar arrangements may also be possible depending on the actual construction composition of the ceiling and driver enclosures.

Figure 6:
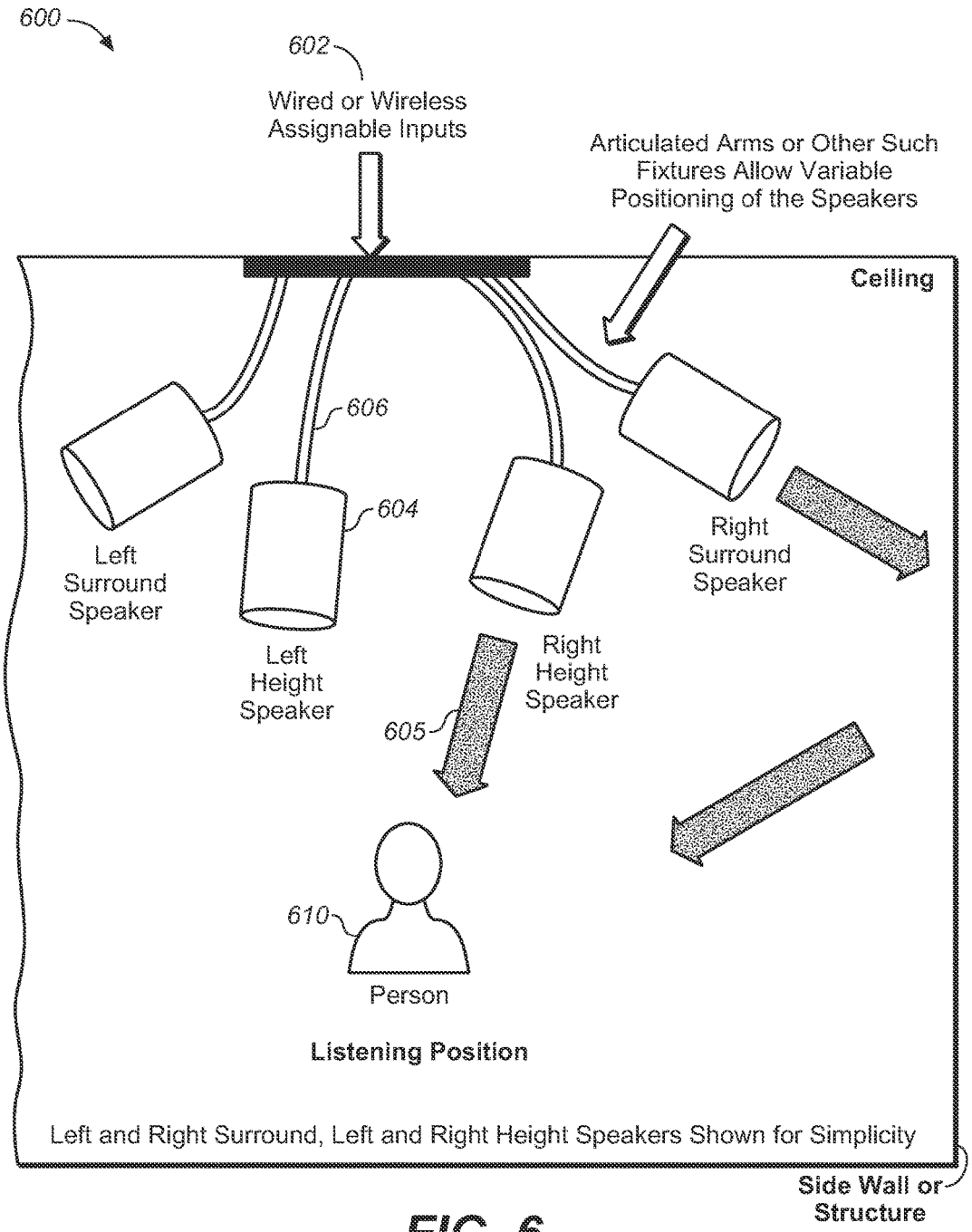
FIG. 6 illustrates a variably aimed cluster of downward and sideward firing drivers under an embodiment.

In an embodiment, one or more of the downward and sideward firing drivers may be independently aimable through the use of special articulating or rotating mechanisms. For example, single or multiple groups of loudspeakers could be clustered together and placed in the ceiling of the room. FIG. 6 illustrates a variably aimed cluster of downward and sideward firing drivers under an embodiment. This cluster would consist of loudspeakers on articulated arms or fixtures, for play back of audio for height and main outputs where each loudspeaker can be angled either directly towards the listener (representing the height outputs) or angled towards a reflecting surface to the side of the listener in order to reflect audio back towards the listener. As shown in diagram 600, a number of independent drivers 604 are suspended under ceiling using arms 606 that are flexible to allow the drivers to be angled virtually anywhere relative to the walls and the listening location 610 through different sound vectors 605. Some drivers may be oriented to fire straight down, while others may be positioned to reflect off the wall or transmit downward at angles. The drivers may comprise a surround sound or partial surround sound arrangement as shown, or any other speaker arrangement. The drivers may be coupled to an integrated audio signal input 602, as shown, or they may be separately coupled to individual audio input feeds. The articulated arms provide for independent positioning of the drivers, and may be implemented through flexible arms, linkages, and other similar mechanisms.

Perceptual Direct Filter

As shown and described above, embodiments for providing a virtual direct audio effect using ceiling/downward firing drivers only have been described. Such systems may also use a perceptual filter to reposition the apparent audio origin without use of mechanical angling of the speaker to reflect audio off a nearby surface structure. Such a filter may be used to improve the sound imaging provided by sideward angled ceiling speakers, or to produce the virtual direct effect using only downward firing speakers with no reflection speakers.

As shown, the adaptive audio system utilizes downward-firing drivers to provide the height element for overhead direct objects. This is achieved partly through the perception of reflected sound from above as shown in FIGS. 1 and 2. In practice, however, sound does not radiate in a perfectly directional manner along the reflected path from the downward-firing driver. Some sound from the downward firing driver(s) will themselves reflect off of the wall surfaces, diminishing the perception of pure height sound and/or the direct sound. The amount of this undesired direct sound in comparison to the desired reflected sound is generally a function of the directivity pattern of the downward firing driver or drivers. To compensate for this undesired sound, it has been shown that incorporating signal processing to introduce perceptual direct cues into the audio signal being fed to the sideward-firing drivers improves the positioning and perceived quality of the virtual direct signal.

An inverse of this filter is next determined and used to remove the directional cues for audio travelling along a path reflected on the wall from the physical speaker location to the listener. Next, for the reflected speaker location, a second directional filter is determined based on a model of sound travelling directly from the reflected speaker location to the ears of a listener at the same listening position using the same model of directional hearing. This filter is applied directly, essentially imparting the directional cues the ear would receive if the sound were emanating from a direct speaker location next to the listener. In practice, these filters may be combined in a way that allows for a single filter that both at least partially removes the directional cues from the physical speaker location, and at least partially inserts the directional cues from the reflected speaker location. Such a single filter provides a frequency response curve that is referred to herein as a "direct filter transfer function," "virtual direct filter response curve," "desired frequency transfer function," "direct cue response curve," or similar words to describe a filter or filter response curve that perceptually filters height sound components from direct sound components in an audio playback system using ceiling mounted speakers to produce main audio signals using wall reflections.

Figure 7A:
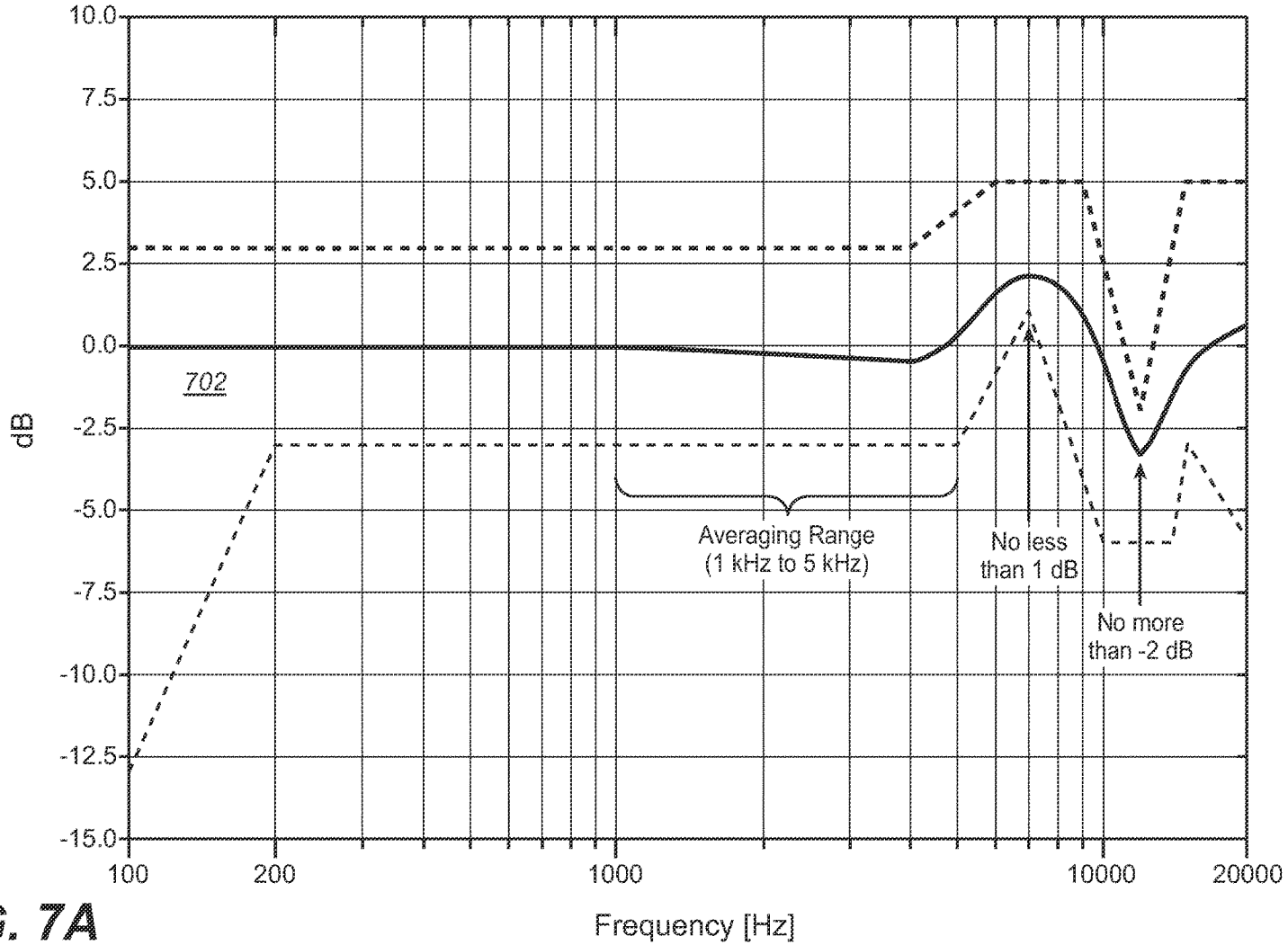
FIG. 7A depicts a direct height filter response curve for reflected sound drivers, under an embodiment.
Figure 7B:
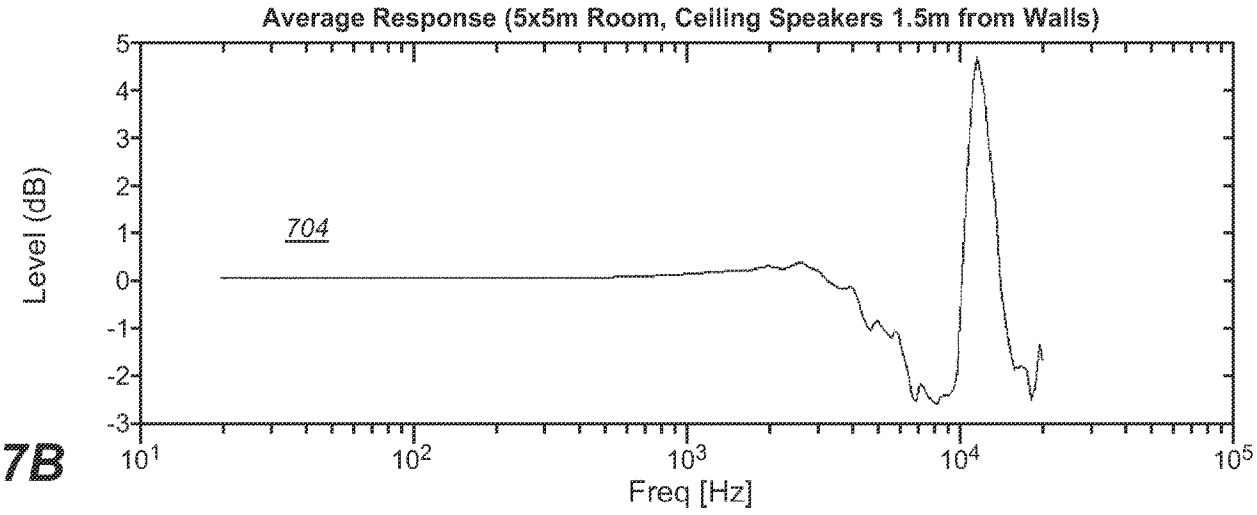
FIG. 7B illustrates an average response curve for a simulation performed to calculate an average filter response.
Figure 7C:
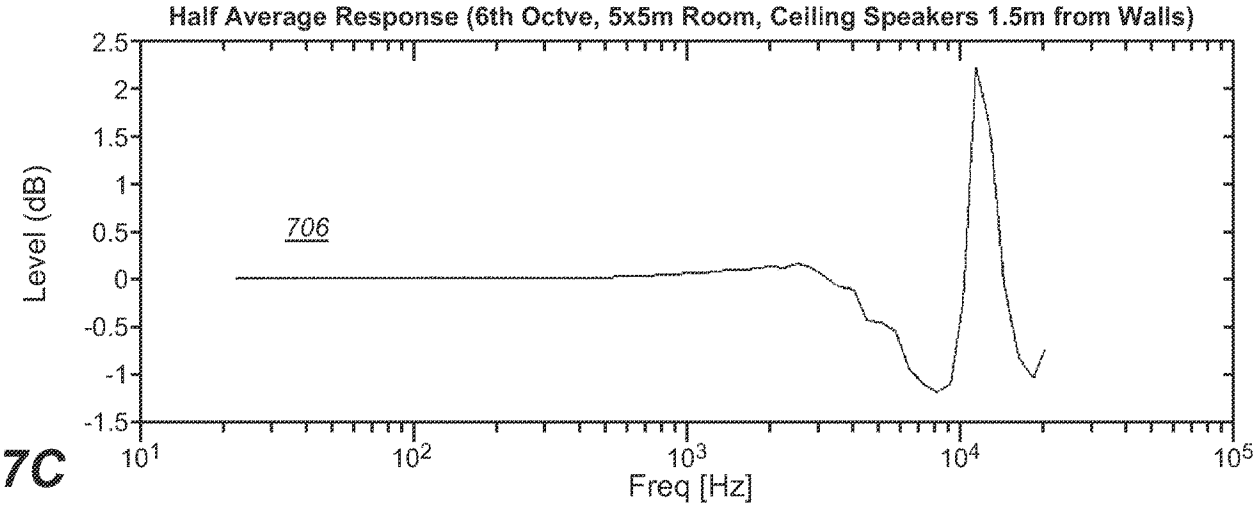
FIG. 7C illustrates a target response curve for a height filter used in a sideward-firing driver system, based on the response curve of FIG. 7B.
Figure 7D:
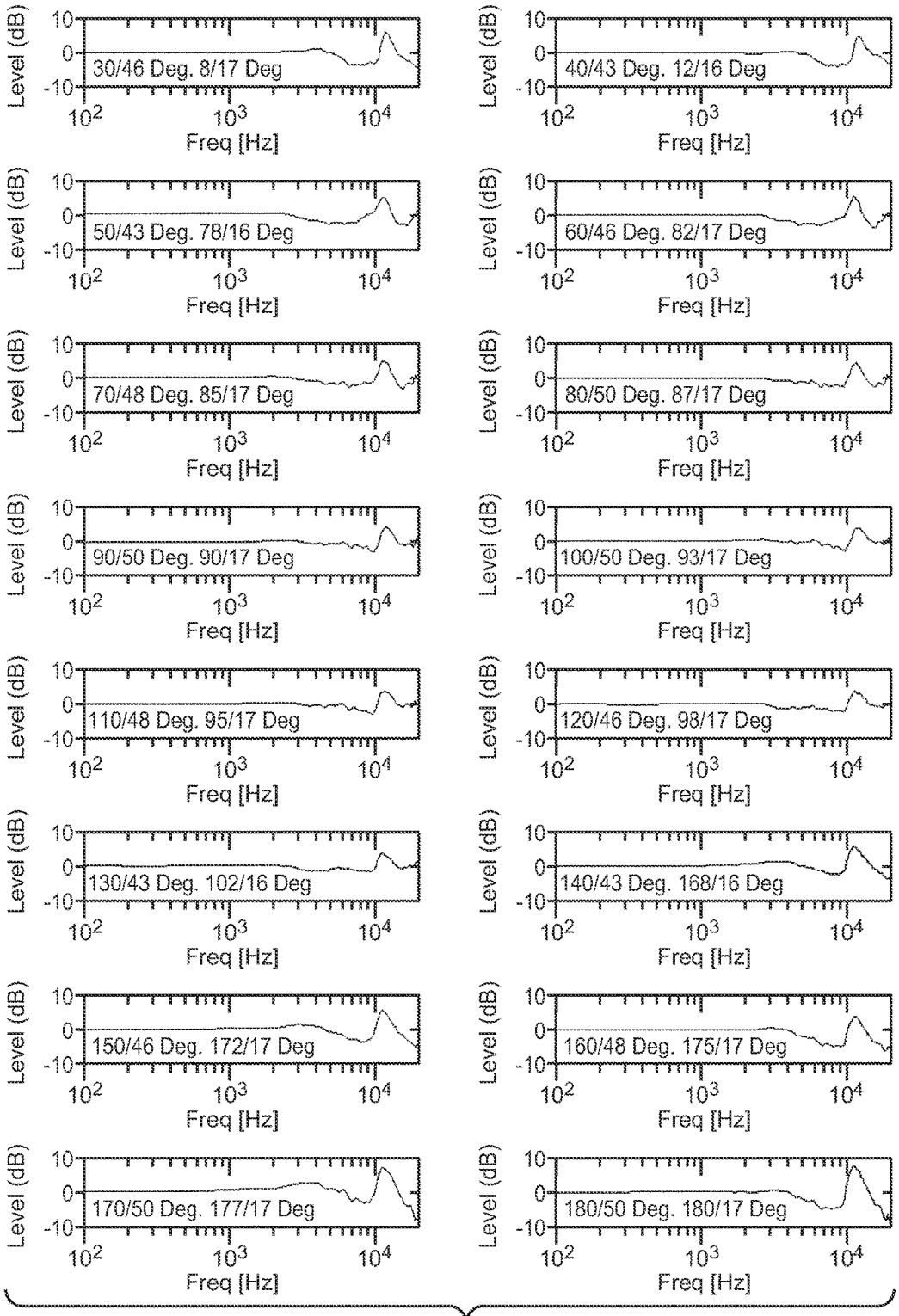
FIG. 7D shows various example response differences that are used to generate the average response curve of FIG. 7B.

FIG. 7A depicts a direct height (perceptual) filter response curve for reflected sound drivers under an embodiment. The typical use of such a virtual direct filter for virtual direct rendering is for audio to be pre-processed by a filter exhibiting a specific magnitude response before it is played through the sideward-firing virtual direct speaker. The filter may be provided as part of the speaker unit, or it may be a separate component that is provided as part of the renderer, amplifier, or other intermediate audio processing component. The frequency response curve 702 of FIG. 7A represents a filter function applied to upward-firing (elevation) speakers that have a desired on-axis response that is approximately half the pinna filter spectral difference between a listening-height level speaker and the ceiling bounce spatial location, which is the location of the ceiling off of which a driver pointed at the ceiling will project the sound to be reflected down to the listener. In an embodiment, for wall reflected sound, as illustrated in FIG. 1, the filter response curve is based on an average filter response difference between a speaker in the ceiling and pointed at wall, and the wall bounce signal (e.g., signal 103 in FIG. 1). FIG. 7B illustrates an average response curve for a simulation performed to calculate an average filter response based on the following assumptions: (1) a 5 m by 5 m room with a ceiling height of 2.4 m, (2) a listening position in the middle of the room at a height of 1 m off the ground, (3) ceiling speakers 1.5 m in from the nearest wall, and (4) a ceiling speaker angled to bounce high frequencies back to the listening position. In accordance with the practice for upward-firing drivers, the desired target response curve for the filter is produced by taking half of the level of curve 704, as shown in curve 706 of FIG. 7C. FIG. 7C illustrates a target response curve for a height filter used in a sideward-firing driver system, under an embodiment. The response curve 706 is shown as smoothed to ⅙ octave relative to the response curve 704. In general, applying the response curve 706 as a filter function to the sideward-bounced audio has less effect in reinforcing the perception of the bounced sound as the pinna filter response curve 702 used for the upward-firing driver. FIG. 7D shows various response differences for ceiling azimuths from 30 degrees to 180 degrees, and that are used to generate the average response curve of FIG. 7B. For the plots of FIG. 7D, four different angles are shown on each plot as follows: ceiling speaker azimuth angle (relative to the forward direction)/ceiling elevation angle from the horizontal plane; and wall image azimuth angle (relative to the forward direction)/wall image elevation angle from the horizontal plane. It should be noted that since the wall images are the result of wall bounce, they will always have a positive elevation angle.

Figure 8A:
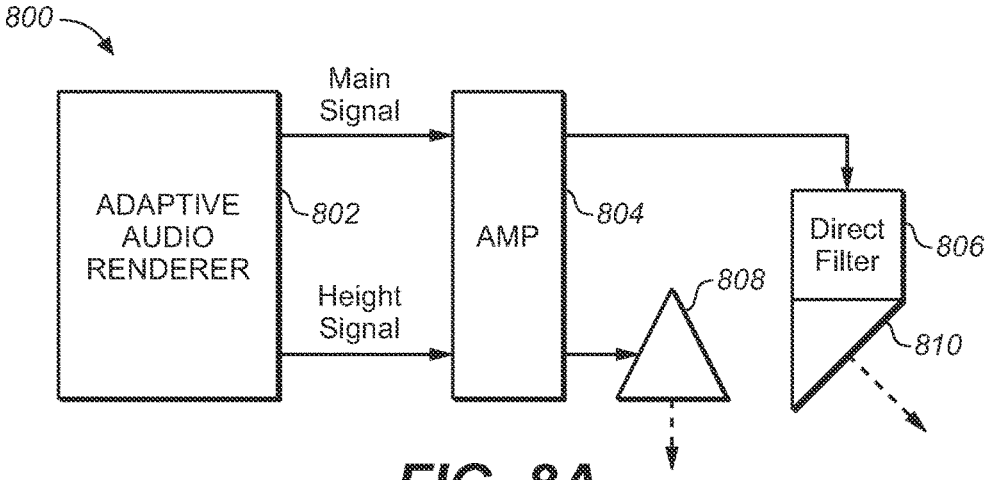
FIG. 8A illustrates a virtual direct filter incorporated as part of a speaker unit having an sideward firing driver, under an embodiment.

FIG. 8A illustrates a virtual direct filter incorporated as part of a speaker unit having a sideward firing driver, under an embodiment. In an embodiment, the virtual direct filter may generate a desired target frequency response curve 706 as shown in FIG. 7C. As shown in system 800 of FIG. 8A, an adaptive audio processor 802 outputs audio signals that contain separate height signal components and main (direct) signal components. The height signal components are meant to be played through a direct downward firing speaker 808, and the direct audio signal component is meant to be played through a sideward firing speaker 810 reflecting sound off of the wall surface. The signal components are not necessarily different in terms of frequency content or audio content, but are instead differentiated on the basis of height cues present in the audio objects or signals. For the embodiment of FIG. 8A, a direct filter 806 contained within or otherwise associated with the sideward firing speaker 810. The direct filter 406 compensates for any undesired downward sound components that may be present in the direct signal by providing perceptual cues into the direct signal to improve the positioning and perceived quality of the virtualized direct signal. As stated above, such a height filter may incorporate the reference curve 706 shown in FIG. 7C.

Figure 8B:
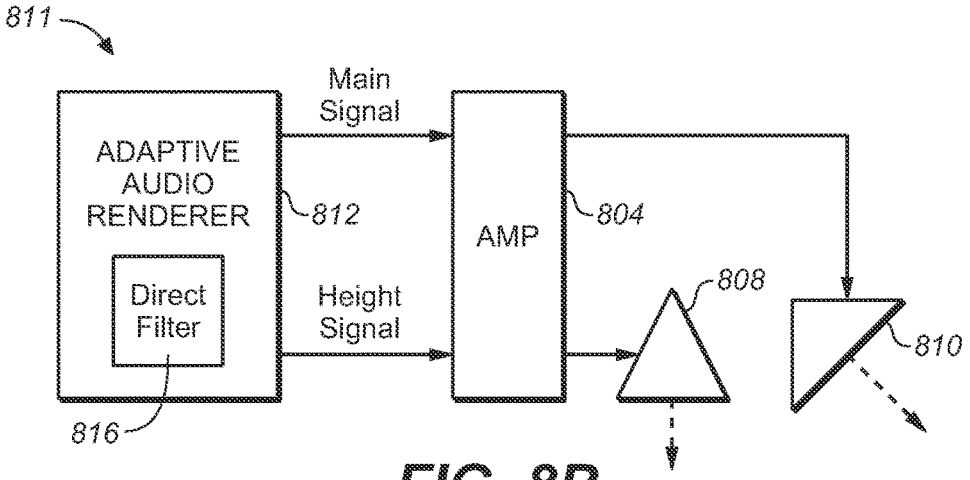
FIG. 8B illustrates a virtual direct filter incorporated as part of a rendering unit for driving an sideward firing driver, under an embodiment.

In an alternative embodiment, the virtual direct filter pre-processing can take place in the rendering equipment prior to input to a speaker amplifier (i.e., an AV receiver or preamp). FIG. 8B illustrates a virtual direct filter incorporated as part of a rendering unit for driving an sideward firing driver, under an embodiment. As shown in system 811 of FIG. 8B, renderer 812 outputs separate height and main signals through amp 804 to drive downward firing drivers 808 and sideward-firing driver 810, respectively. A direct filter 816 within the renderer 812 provides the height sound compensation through a notch filter (e.g., reference curve 702) for the sideward-firing driver 810, as described above with respect to FIG. 8A. This allows the direct filter function to be provided for speakers that do not have any built-in virtual direct filtering.

In an embodiment, the virtual direct filter function may be provided in a downward-firing driver array that comprises only downward firing driver or drivers. No reflection speakers are provided for such an embodiment.

Bypass Signal

Figure 9:
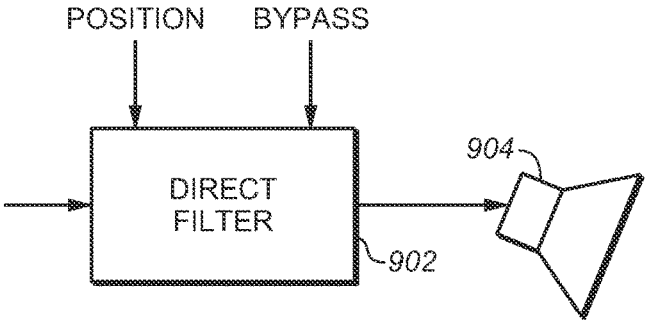
FIG. 9 illustrates a direct filter receiving positional information and a bypass signal, under an embodiment.

In an embodiment, certain positional information is provided to the direct filter, along with a bypass signal to enable or disable the virtual direct filter within the speaker system. FIG. 9 illustrates a height direct receiving positional information and a bypass signal, under an embodiment. As shown in FIG. 9, positional information is provided to the virtual direct filter 902, which is connected to the sideward firing speaker 904. The positional information may include speaker position and room size utilized for the selection of the proper virtual direct filter response from the set depicted in FIG. 7. In addition, this positional data may be utilized to vary the declination angle of the virtual direct speaker 904 if such angle is made adjustable through either automatic or manual means. A typical and effective angle for most cases is approximately 45 degrees relative to the ceiling plane.

As shown in FIGS. 8A and 8B, the renderer outputs separate height and direct signals to directly the respective sideward firing and direct speakers. Alternatively, the renderer could output a single audio signal that is separated into height and direct components by a discrete separation or crossover circuit. In this case, the audio output from the renderer would be separated into its constituent height and direct components by a separate circuit. In certain cases the height and direct components are not frequency dependent and an external separation circuit is used to separate the audio into height and direct sound components and route these signals to the appropriate respective drivers, where virtual direct filtering would be applied to the sideward firing speaker signal.

Figure 10:
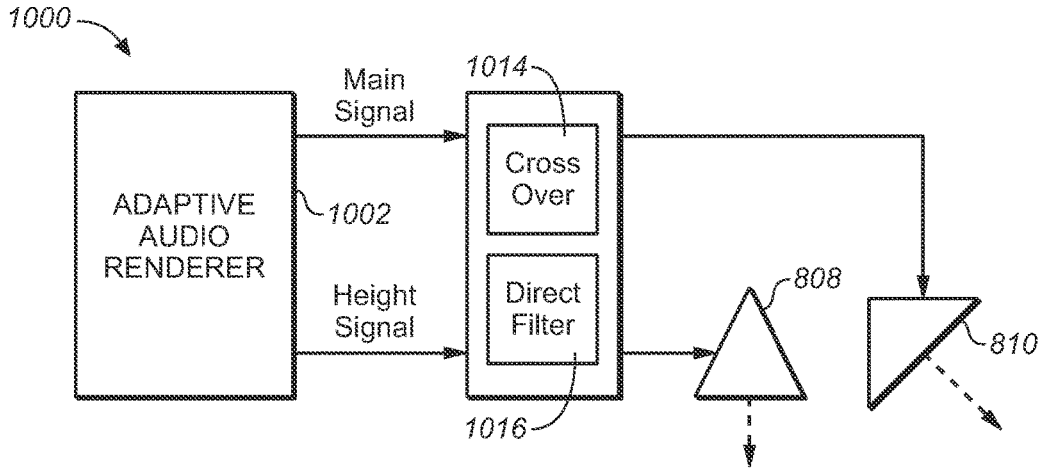
FIG. 10 is a diagram illustrating a virtual direct filter system including crossover circuit, under an embodiment.

In most common cases, however, the height and direct components may be frequency dependent, and the separation circuit comprises crossover circuit that separates the full-bandwidth signal into low and high (or bandpass) components for transmission to the appropriate drivers. This is often the most useful case since height cues are typically more prevalent in high frequency signals rather than low frequency signals, and for this application, a crossover circuit may be used in conjunction with or integrated in the virtual direct filter component to route high frequency signals to the downward firing driver(s) and lower frequency signals to the sideward firing (main) driver(s). FIG. 10 is a diagram illustrating a direct height filter system including crossover circuit, under an embodiment. As shown in system 1000, output from the renderer 1002 through an amp (not shown) is a full bandwidth signal and a virtual direct speaker filter 1016 is used to impart the desired direct filter transfer function for signals sent to the sideward firing speaker 810. A crossover circuit 1016 separates the full bandwidth signal from renderer 1002 into high (upper) and low (direct) frequency components for transmission to the appropriate drivers. The crossover 1014 may be integrated with or separate from the direct filter 1016, and these separate or combined circuits may be provided anywhere within the signal processing chain, such as between the renderer and speaker system (as shown), as part of an amp or pre-amp in the chain, within the speaker system itself, or as components closely coupled or integrated within the renderer 1002. The crossover function may be implemented prior to or after the direct height filtering function.

A crossover circuit typically separates the audio into two or three frequency bands with filtered audio from the different bands being sent to the appropriate drivers within the speaker. For example in a two-band crossover, the lower frequencies are sent to a larger driver capable of faithfully reproducing low frequencies (e.g., woofer/midranges) and the higher frequencies are typically sent to smaller transducers (e.g., tweeters) that are more capable of faithfully reproducing higher frequencies.

Room Correction with Virtual Direct Speakers

As discussed above, adding virtual direct filtering to a virtual direct speaker adds perceptual cues to the audio signal that add or improve the perception of main audio to sideward-firing speakers. Incorporating virtual direct filtering techniques into speakers and/or renderers may need to account for other audio signal processes performed by playback equipment. One such process is room correction, which is a process that is common in commercially available AVRs. Room correction techniques utilize a microphone placed in the listening environment to measure the time and frequency response of audio test signals played back through an AVR with connected speakers. The purpose of the test signals and microphone measurement is to measure and compensate for several key factors, such as the acoustical effects of the room and environment on the audio, including room nodes (nulls and peaks), non-ideal frequency response of the playback speakers, time delays between multiple speakers and the listening position, and other similar factors. Automatic frequency equalization and/or volume compensation may be applied to the signal to overcome any effects detected by the room correction system. For example, for the first two factors, equalization is typically used to modify the audio played back through the AVR/speaker system, in order to adjust the frequency response magnitude of the audio so that room nodes (peaks and notches) and speaker response inaccuracies are corrected.

If virtual direct speakers are used in the system and virtual filtering is enabled, a room correction system may detect the virtual direct filter as a room node or speaker anomaly and attempt to equalize the direct height magnitude response to be flat. This attempted correction is especially noticeable if the direct height filter exhibits a pronounced high frequency notch, such as when the inclination angle is relatively high.

Figure 11:
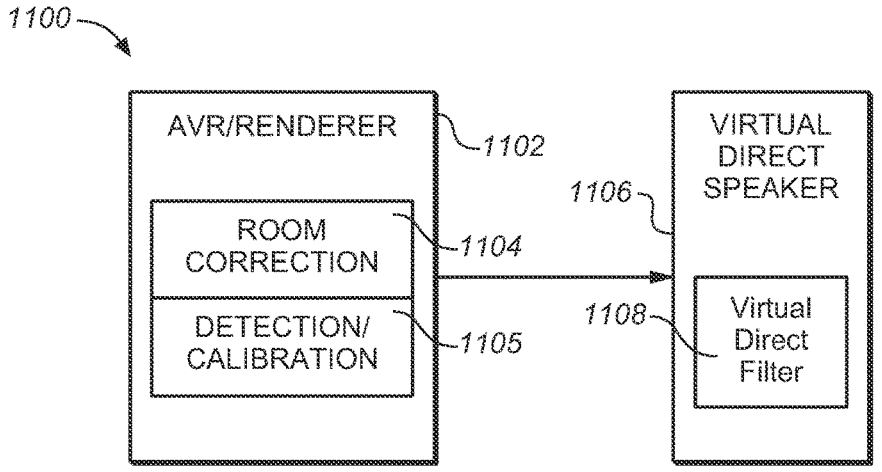
FIG. 11 is a block diagram of a virtual direct rendering system that includes room correction and direct height speaker detection capabilities, under an embodiment.

Embodiments of a virtual direct speaker system include techniques and components to prevent a room correction system from undoing the virtual direct filtering. FIG. 11 is a block diagram of a virtual direct rendering system that includes room correction and virtual direct speaker detection capabilities, under an embodiment. As shown in diagram 1100, an AVR or other rendering component 1102 is connected to one or more virtual direct speakers 1106 that incorporates a virtual direct filter process 1108. This filter produces a frequency response, such as illustrated in FIG. 7C, which may be susceptible to room correction 1104 or other anomaly compensation techniques performed by renderer 1102.

In an embodiment, the room correction compensation component includes a component 1105 that allows the AVR or other rendering component to detect that a virtual direct speaker is connected to it. One such detection technique is the use of a room calibration user interface and a speaker definition that specifies a type of speaker as a virtual or non-virtual direct speaker. Present audio systems often include an interface that ask the user to specify the size of the speaker in each speaker location, such as small, medium, large. In an embodiment, a virtual direct speaker type is added to this definition set. Thus, the system can anticipate the presence of virtual direct speakers through an additional data element, such as small, medium, large, virtual direct, etc. In an alternative embodiment, a virtual direct speaker may include signaling hardware that states that it is a virtual direct speaker as opposed to a non-virtual direct speaker. In this case, a rendering device (such as an AVR) could probe the speakers and look for information regarding whether any particular speaker incorporates virtual direct technology. This data could be provided via a defined communication protocol, which could be wireless, direct digital connection or via a dedicated analog path using existing speaker wire or separate connection. In a further alternative embodiment, detection can be performed through the use of test signals and measurement procedures that are configured or modified to identify the unique frequency characteristics of a virtual direct filter in a speaker and determine that a virtual direct speaker is connected via analysis of the measured test signal.

Once a rendering device with room correction capabilities has detected the presence of a virtual direct speaker (or speakers) connected to the system, a calibration process 1105 is performed to correctly calibrate the system without adversely affecting the virtual direct filtering function 1108. In one embodiment, calibration can be performed using a communication protocol that allows the rendering device to have the virtual direct speaker 1106 bypass the virtual direct filtering process 1108. This could be done if the speaker is active and can bypass the filtering. The bypass function may be implemented as a user selectable switch, or it may be implemented as a software instruction (e.g., if the filter 1108 is implemented in a DSP), or as an analog signal (e.g., if the filter is implemented as an analog circuit).

Figure 12:
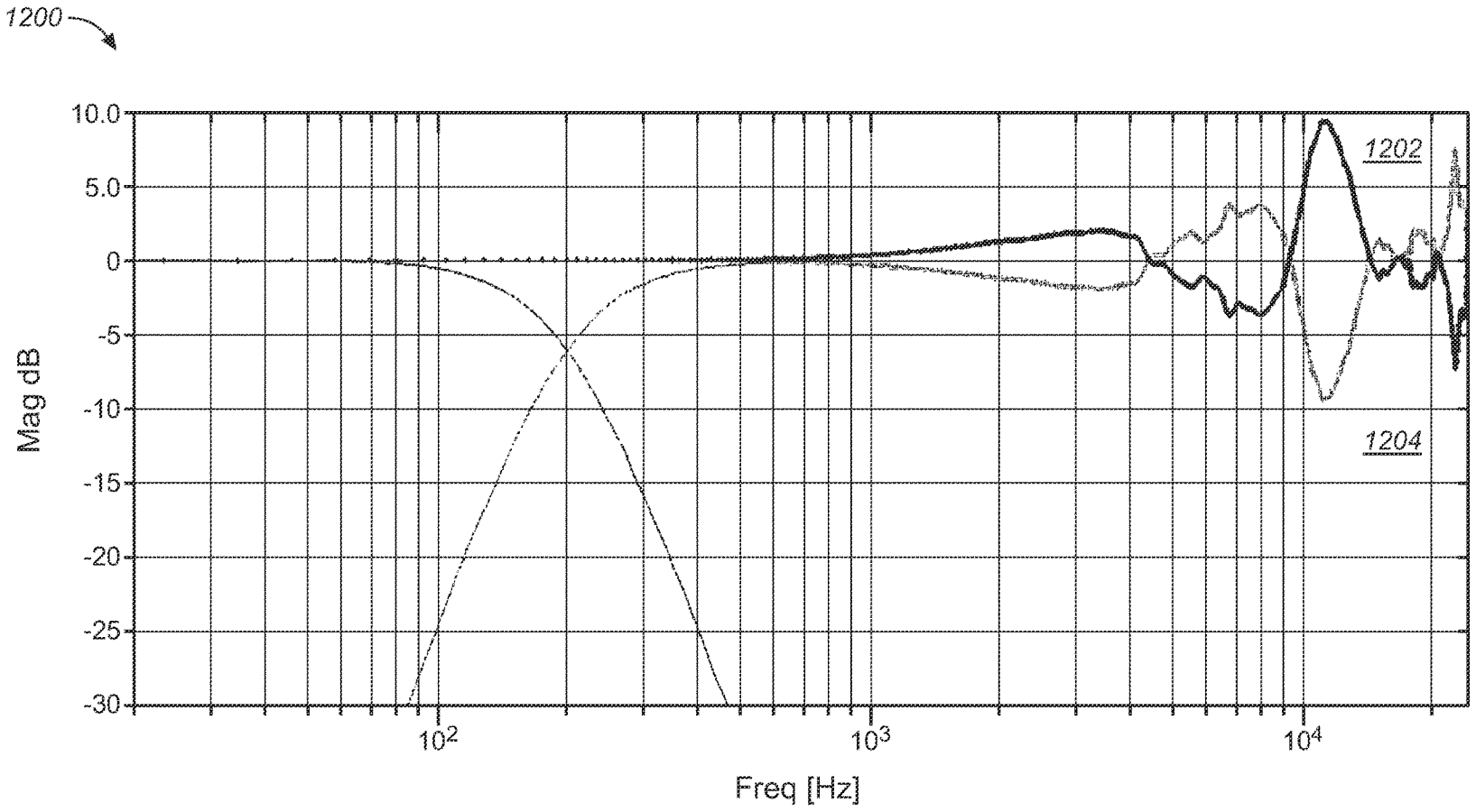
FIG. 12 is a graph that displays the effect of pre-emphasis filtering for calibration, under an embodiment.

In an alternative embodiment, system calibration can be performed using pre-emphasis filtering. In this embodiment, the room correction algorithm 1104 performs pre-emphasis filtering on the test signal it generates and outputs to the speakers for use in the calibration process. FIG. 12 is a graph that displays the effect of pre-emphasis filtering for calibration, under an embodiment. Plot 1200 illustrates a typical frequency response for a virtual direct filter 1204, and a complimentary pre-emphasis filter frequency response 1202. The pre-emphasis filter is applied to the audio test signal used in the room calibration process, so that when played back through the virtual direct speaker, the effect of the filter is cancelled, as shown by the complementary plots of the two curves 1202 and 1204 in the upper frequency range of plot 1200. In this way, calibration would be applied as if using a normal, non-virtual direct speaker.

In yet a further alternative embodiment, calibration can be performed by adding the virtual direct filter response to the target response of the calibration system.

In either of these two cases (pre-emphasis filter or modification of target response), the virtual direct filter used to modify the calibration procedure may be chosen to match exactly the filter utilized in the speaker. If, however, the virtual direct filter utilized inside the speaker is a universal filter, such as curve 702, which is not modified as a function of the speaker location and room dimensions, then the calibration system may instead select a virtual direct filter response corresponding to the actual location and dimensions if such information is available to the system. In this way, the calibration system applies a correction equivalent to the difference between the more precise, location dependent virtual direct filter response and the universal response utilized in the speaker. In this hybrid system, the fixed filter in the speaker provides a good virtual direct effect, and the calibration system in the AVR further refines this effect with more knowledge of the listening environment.

Figure 13:
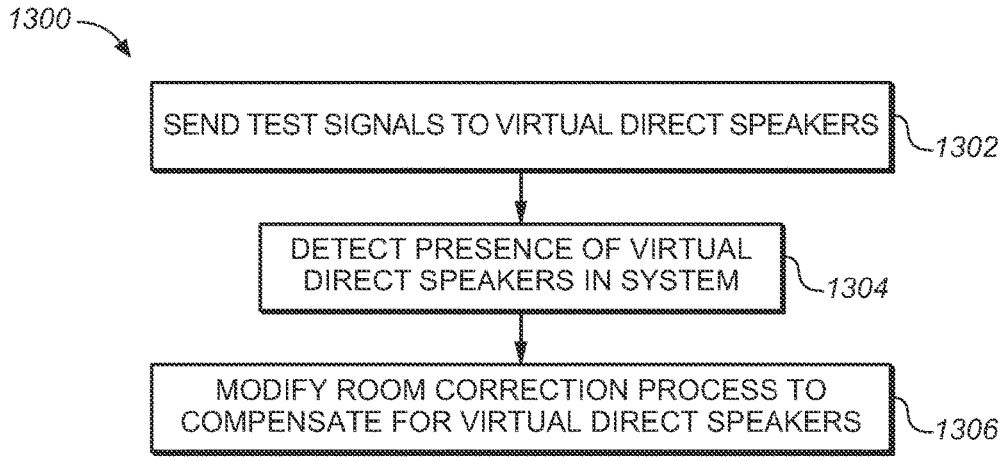
FIG. 13 is a flow diagram illustrating a method of performing virtual direct filtering in an adaptive audio system, under an embodiment.

FIG. 13 is a flow diagram illustrating a method of performing virtual direct filtering in an adaptive audio system, under an embodiment. The process of FIG. 13 illustrates the functions performed by the components shown in FIG. 11. Process 1300 starts by sending a test signal or signals to the virtual direct speakers with built-in virtual direct filtering, act 1302. The built-in virtual direct filtering produces a frequency response curve, such as that shown in FIG. 7C, which may be seen as an anomaly that would be corrected by any room correction processes. In act 1304, the system detects the presence of the virtual direct speakers, so that any modification due to application of room correction methods may be corrected or compensated to allow the operation of the virtual direct filtering of the virtual direct speakers, act 1306.

As described above and illustrated in FIGS. 4A-B and 7A-D, the virtual direct filter may be implemented in a speaker either on its own or with or as part of a crossover circuit that separates input audio frequencies into high and low bands, or more depending on the crossover design. Either of these circuits may be implemented as a digital DSP circuit or other circuit that implements an FIR (finite impulse response) or IIR (infinite impulse response) filter to approximate the virtual direct filter curve, such as shown in FIG. 7C. Either of the crossover, separation circuit, and/or virtual direct filter may be implemented as passive or active circuits, wherein an active circuit requires a separate power supply to function, and a passive circuit uses power provided by other system components or signals.

Native Transducer Design

Embodiments have been described wherein the virtual direct frequency curve for use with sideward firing drivers is provided by a specific circuit or digital processing component. Such a circuit may add a certain amount of cost and complexity to an audio playback system, which may be undesirable. In an embodiment, the desired virtual direct transfer function may be designed into the sideward firing driver's native frequency response. Many speakers have inherent high frequency errors by parts that do not remain linear in the speakers operating range, and that may be similar to the desired direct filter transfer function. In current driver designs, these errors are typically minimized to produce a more linear speaker. However, a specific non-linear response to improve direct cue information may be designed directly into drivers intended to reflect sound off of ceiling surfaces. Certain characteristics and components of the drivers or transducers of the sideward firing speaker may be modified to incorporate a specific direct cue transfer curve.

Certain elements of the sideward firing driver are modified to create the desired direct transfer function 1804 natively in the driver itself, and may include the driver cone, dust cap, spider, or other elements. In an embodiment, the driver cone and/or cone edge may be modified. A cone edge assembly with a thin band on the perimeter of the cone or multiple varying thickness bands may be used. The cone may alternatively include a hinged section or multiple hinged sections using 'u' or 'v' shaped areas on the cone. The driver may also utilize bands of the cone area that are not tangent to the main cone profile, i.e., zig-zag profiles; or a section of the outside cone perimeter that is at a very small angle to the front plane of the speaker producing a substantially flat area. Alternatively, a section of the inside edge perimeter that is at a very small angle to the front plane of the speaker may be used to create a substantially flat area that can radiate independent of the cone body. This may also be accomplished by a section of the inside edge perimeter that is at a very acute angle to the front plane of the speaker with a large increase in the moment arm mass at the junction of the cone/edge assembly. The cone may also incorporate a hinged section or multiple hinged sections using 'u' or 'v' shaped areas on the edge; or an edge with a substantially asymmetrical compliance between the forward and rear excursion that creates harmonics in the required band. These design variations are all meant to introduce harmonics that help create the desired response curve for the driver.

The driver cone is often capped with a dust cap positioned in the center of the cone circle. The dust cap may also be configured to help produce the desired frequency curve. For example, a cone dust cap assembly with a hinged cone section or thin cone sections that allow the dust cap to vibrate at high frequencies in a substantially decoupled mode may be used. Alternatively, the dust cap may be shaped to become an efficient secondary radiator at the desired height frequency range. Similarly, a dust cap with a cone shaped whizzer or other spinning or vibrating element that is shaped to become an efficient secondary radiator at the height frequency range may be used. Such a dust cap may be modified and used by itself, or in combination with modified cone assembly.

The cone is typically supported by a plastic or metal frame called a spider. In an embodiment, the spider may be modified instead of, or in conjunction with the cone and/or dust cap. For example, a spider with a substantially asymmetrical compliance between the forward and rear excursion that creates harmonics in the required band may be used.

Certain specifications may be defined to optimize the sideward firing driver. For example, the specification may define a transducer incorporating a cone with a varying cross-section shape that creates a high frequency response with specific rises and notches, as shown in FIG. 7C, and such a varying cross-section shape may include an annular section creating a hinge that allows this section cone to vibrate anti-phase to the rest of the cone body. It should be noted that all of the cited modifications to the driver elements may be used alone or in combination with each other to produce the desired frequency response curve.

Instead of the cone portion of the driver, the desired frequency curve may be built into the speaker using other or additional speaker components. In an embodiment, a wave guide (e.g., horn, lens, etc.) is used independently or in conjunction with the sideward firing driver to produce the target desired target function 1804. This embodiment uses a waveguide to create the desired transfer function by controlling directivity. For this embodiment, the desired transfer function itself is created by the waveguide shape, and/or the use of the waveguide in conjunction with the optimized driver creates the desired transfer function.

Aspects of the systems described herein may be implemented in an appropriate computer-based sound processing network environment for processing digital or digitized audio files. Portions of the adaptive audio system may include one or more networks that comprise any desired number of individual machines, including one or more routers (not shown) that serve to buffer and route the data transmitted among the computers. Such a network may be built on various different network protocols, and may be the Internet, a Wide Area Network (WAN), a Local Area Network (LAN), or any combination thereof.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A system for rendering sound using reflected sound elements, comprising:

a renderer generating main signal components of an audio signal intended to be reflected off of a side surface of a listening environment, and height signal components of the audio signal intended to be transmitted directly into the listening environment;

at least one speaker for playing the audio signal, and having at least one direct firing driver for transmission of the height signal components and at least one sideward firing driver for transmission of the main signal components;

a unitary cabinet containing both the sideward firing driver and the direct firing driver, wherein the sideward firing driver is disposed at an inclination angle of between 30 degrees and 45 degrees relative to a horizontal angle defined by the direct firing driver, and further wherein the sideward firing driver is coupled to the unitary cabinet through a movable apparatus;

a direct filter configured to at least partially remove directional cues from the at least one speaker location, and at least partially insert the directional cues from a reflected speaker location.

2. The system of claim 1 wherein the direct filter comprises a circuit embodied in one of: a component disposed between the renderer and the at least one speaker, a component provided as part of the renderer, and a component built into the at least one speaker.

3. The system of claim 1 wherein the audio signal comprises a full bandwidth signal, the system further comprising a crossover circuit configured to transmit high frequency components above a cutoff frequency to the direct firing driver and low frequency components below the cutoff frequency to the sideward firing driver.

4. The system of claim 1 wherein the direct firing driver is configured to transmit sound directly downward to a listening area in the listening environment.

5. The system of claim 1 wherein the direct firing and sideward firing drivers are provided in one of a unitary enclosure or separate enclosure system installed in a ceiling of the listening environment.

6. The system of claim 1 wherein the direct firing and sideward firing drivers are provided in one of a unitary enclosure or separate enclosure system mounted on a ceiling of the listening environment.

7. The system of claim 1 wherein the direct firing and sideward firing drivers comprise at least part of a surround sound system installed in a ceiling portion of the listening environment.

8. A system for rendering sound using reflected sound elements, comprising:

a speaker placed at a speaker location and comprising a housing enclosing a plurality of drivers, wherein a first driver of the plurality of drivers is a downward-firing driver configured to transmit sound waves along a first axis proximately perpendicular to the ground plane, and a second driver of the plurality of drivers is a sideward-firing driver oriented at a variable inclination angle relative to the ground plane and configured to reflect sound off a wall surface of a listening environment to produce a reflected speaker location;

a virtual direct filter applying a frequency response curve to an audio signal generated by a renderer and transmitted to the sideward-firing driver, wherein the virtual direct filter at least partially removes directional cues from the speaker location and at least partially inserts the directional cues from the reflected speaker location;

a location component configured to determine an optimum listening position within the listening environment;

a communication component configured to communicate the optimum listening position to the speaker; and a control component configured to alter the inclination angle to reflect the sound waves off of the wall surface to the optimum listening position.

9. The system of claim 8 wherein the audio signal comprises a full bandwidth signal, the system further comprising a crossover coupled to the speaker, the crossover having a low-pass section configured to transmit low frequency signals below a threshold frequency to the sideward-firing driver, and a high-pass section configured to transmit high frequency signals above the threshold frequency to the direct firing driver.

10. The system of claim 9 wherein the virtual direct filter is integrated with the crossover as part of an integrated crossover/filter circuit.

11. The system of claim 10 wherein the crossover/filter circuit is one of: a digital component implemented as a digital signal processor (DSP) device or a logic gate circuit, and an analog circuit, and wherein the crossover/filter circuit is one of a: passive device network and an active device network.

12. The system of claim 8 further comprising a detection component configured to detect the presence of the virtual direct filter in the listening environment.

13. The system of claim 8 further comprising a bypass switch to bypass the virtual direct filter during a calibration process that prepares audio playback equipment to transmit the sound waves to the listening environment.

14. The system of claim 8 further comprising a room correction component performing a pre-emphasis filtering operation on the sound waves transmitted to the listening environment to compensate for the virtual direct filtering applied to the signal transmitted to the sideward-firing driver.

15. The system of claim 8 wherein the direct firing and sideward firing drivers are provided in one of a unitary enclosure or separate enclosure system installed in a ceiling of the listening environment.

16. The system of claim 8 wherein the direct firing and sideward firing drivers are provided in one of a unitary enclosure or separate enclosure system mounted on a ceiling of the listening environment.

17. The system of claim 8 wherein the direct firing and sideward firing drivers comprise at least part of a surround sound system installed in a ceiling portion of the listening environment.

18. A speaker for transmitting sound waves to be reflected off a wall surface of a listening environment, comprising:

a housing;

a sideward-firing driver within the housing and oriented at an inclination angle relative to a ground plane and configured to reflect sound off a reflection point on the wall surface of the listening environment;

a virtual direct filter applying a frequency response curve to a signal transmitted to the sideward-firing driver, wherein the virtual direct filter is configured to remove height cues present in sound waves transmitted directly through the listening environment in favor of height cues present in the sound reflected off the wall surface of the listening environment; and a partially blocking baffle system blocking direct off-axis energy to the listening position from the sideward firing driver.

19. The speaker of claim 18, further comprising a direct-firing driver within the housing configured to transmit sound waves along an axis proximately perpendicular to the ground plane.

* * * * *